US011450285B2

(12) United States Patent
Li et al.

(10) Patent No.: US 11,450,285 B2
(45) Date of Patent: Sep. 20, 2022

(54) BACKLIGHT ADJUSTMENT CIRCUIT, BACKLIGHT MODULE AND DISPLAY DEVICE

(71) Applicant: HKC CORPORATION LIMITED, Guangdong (CN)

(72) Inventors: Wenxin Li, Guangdong (CN); Xiaoyu Huang, Guangdong (CN)

(73) Assignee: HKC CORPORATION LIMITED, Guangdong (CN)

( * ) Notice: Subject to any disclaimer, the term of this patent is extended or adjusted under 35 U.S.C. 154(b) by 0 days.

(21) Appl. No.: 17/272,656

(22) PCT Filed: Dec. 21, 2018

(86) PCT No.: PCT/CN2018/122541
§ 371 (c)(1),
(2) Date: Mar. 2, 2021

(87) PCT Pub. No.: WO2020/098073
PCT Pub. Date: May 22, 2020

(65) Prior Publication Data

US 2021/0343249 A1 Nov. 4, 2021

(30) Foreign Application Priority Data

Nov. 12, 2018 (CN) ..... 201811339419.4

(51) Int. Cl.
*G09G 3/34* (2006.01)
*G09G 3/36* (2006.01)

(52) U.S. Cl.
CPC ..... *G09G 3/3406* (2013.01); *G09G 3/36* (2013.01); *G09G 2320/0626* (2013.01)

(58) Field of Classification Search
CPC ..... G09G 3/3406; G09G 3/36; G09G 2320/0626; G09G 2320/0233; G09G 3/3413; G09G 3/342; H05B 45/00
See application file for complete search history.

(56) References Cited

U.S. PATENT DOCUMENTS 6,441,558 B1 * 8/2002 Muthu ..... H05B 45/22 315/149
7,777,704 B2 * 8/2010 S ..... H05B 45/38 345/82

(Continued)

FOREIGN PATENT DOCUMENTS

CN 101236725 A 8/2008
CN 101236726 A 8/2008

(Continued)

OTHER PUBLICATIONS

First Office Action in counterpart Chinese Application No. 201811339419.4, dated Dec. 4, 2019.

(Continued)

*Primary Examiner* — Benyam Ketema

(57) ABSTRACT

Disclosed is a backlight adjustment circuit including: a reference electrical information circuit, a feedback selection circuit, a main control circuit and at least two parallel light-emitting branches; where the reference electrical information circuit is connected to the main control circuit and is configured to provide reference electrical parameter information to the main control circuit; the feedback selection circuit is respectively connected to the main control circuit and the at least two light-emitting branches and is configured to provide the main control circuit with electrical information of each of the at least two light-emitting branches; and the main control circuit is connected to the at least two light-emitting branches and is configured to adjust a current magnitude of the each of the at least two light-emitting (Continued)

branches according to the reference electrical parameter information and the electrical information of the each of the at least two light-emitting branches.

14 Claims, 4 Drawing Sheets

(56) References Cited

U.S. PATENT DOCUMENTS

| | | | | |
|---|---|---|---|---|
| 8,963,443 | B2 * | 2/2015 | Choi | H05B 45/46 315/308 |
| 9,030,121 | B2 * | 5/2015 | Lin | H05B 45/44 315/291 |
| 9,099,045 | B2 * | 8/2015 | Ueda | G09G 3/3426 |
| 9,781,806 | B1 * | 10/2017 | Yeh | H05B 45/46 |
| 10,580,366 | B2 * | 3/2020 | Chen | G02F 1/133602 |
| 2003/0025462 | A1 * | 2/2003 | Weindorf | H05B 41/3927 315/DIG. 4 |
| 2004/0135522 | A1 * | 7/2004 | Berman | H05B 45/20 315/185 S |
| 2005/0231127 | A1 * | 10/2005 | Yamamoto | H05B 45/38 315/224 |
| 2007/0115662 | A1 | 5/2007 | Roberts et al. | |
| 2007/0195024 | A1 * | 8/2007 | Korcharz | G09G 3/342 345/82 |
| 2007/0195025 | A1 * | 8/2007 | Korcharz | H05B 45/46 345/82 |
| 2008/0068298 | A1 * | 3/2008 | Shen | G09G 3/14 345/46 |
| 2008/0106505 | A1 * | 5/2008 | Chou | H05B 45/38 345/83 |
| 2009/0097180 | A1 * | 4/2009 | Feng | H05B 41/2855 361/91.1 |
| 2010/0164403 | A1 * | 7/2010 | Liu | H05B 45/347 315/297 |
| 2012/0062131 | A1 * | 3/2012 | Choi | H05B 45/46 315/192 |
| 2012/0153853 | A1 * | 6/2012 | Ye | H05B 45/46 315/193 |
| 2014/0375930 | A1 * | 12/2014 | Zhang | H05B 45/38 315/186 |
| 2016/0042699 | A1 * | 2/2016 | Min | G09G 3/3413 345/82 |
| 2017/0287389 | A1 * | 10/2017 | Kang | G02F 1/133621 |
| 2018/0293946 | A1 | 10/2018 | Li | |

FOREIGN PATENT DOCUMENTS

| | | | |
|---|---|---|---|
| CN | 101604507 | A | 12/2009 |
| CN | 101772237 | A | 7/2010 |
| CN | 101916550 | A | 12/2010 |
| CN | 101917809 | A | 12/2010 |
| CN | 201689649 | U | 12/2010 |
| CN | 101390449 | B | 9/2011 |
| CN | 202949606 | U | 5/2013 |
| CN | 103177698 | A | 6/2013 |
| CN | 103839529 | A | 6/2014 |
| CN | 104505034 | A | 4/2015 |
| CN | 105023539 | A | 11/2015 |
| CN | 105206224 | A | 12/2015 |
| CN | 106205504 | A | 12/2016 |
| CN | 106910476 | A | 6/2017 |
| JP | 2006146171 | A | 6/2006 |

OTHER PUBLICATIONS

The Second Office Action in counterpart Chinese Application No. 201811339419.4, dated May 25, 2020.

International Search Report in corresponding PCT Application No. PCT/CN2018/122541, dated Aug. 9, 2019 and Written Opinion of the International Searching Authority in corresponding PCT Application No. PCT/CN2018/122541, dated Aug. 9, 2019.

* cited by examiner

BACKLIGHT ADJUSTMENT CIRCUIT, BACKLIGHT MODULE AND DISPLAY DEVICE

CROSS-REFERENCE TO RELATED APPLICATIONS

This application is the National Stage of International Application No. PCT/CN2018/122541, filed on Dec. 21, 2018, which claims the benefit of Chinese Patent application No. 2018/1339419.4, filed on Nov. 12, 2018 and entitled "Backlight Adjustment Circuit and Display Device", the entirety of which is hereby incorporated herein by reference.

FIELD

The application relates to a backlight adjustment circuit, a backlight module and a display device.

BACKGROUND

The statements here only provide background information related to this application, and do not necessarily constitute prior art.

Liquid crystal display devices are currently the mainstream products for flat panel displays. Since the liquid crystal itself does not emit light, it needs to be matched with a backlight source for display. The uniformity of the backlight is one of the important factors that affect the effect of the liquid crystal display. Applicant(s) realized that it is difficult to adjust the brightness of the backlight after the traditional backlight structure is manufactured, and it is easy to cause uneven backlighting, which will have negative impacts on the display effect.

SUMMARY

According to various embodiments disclosed in this application, a backlight adjustment circuit and a display device are provided.

A backlight adjustment circuit includes: a reference electrical information circuit, a feedback selection circuit, a main control circuit and at least two parallel light-emitting branches;

where the reference electrical information circuit is connected to the main control circuit and is configured to provide reference electrical parameter information to the main control circuit; the feedback selection circuit is respectively connected to the main control circuit and the at least two light-emitting branches and is configured to provide the main control circuit with electrical information of each of the at least two light-emitting branches; and the main control circuit is connected to the at least two light-emitting branches and is configured to adjust a current magnitude of the each of the at least two light-emitting branches according to the reference electrical parameter information and the electrical information of the each of the at least two light-emitting branches.

In some embodiments, the feedback selection circuit includes a matrix circuit configured to gate the at least two light-emitting branches, and the matrix circuit includes first transistors arranged in a matrix.

In some embodiments, a number of rows of the matrix circuit corresponds to a number of the at least two light-emitting branches, the first transistors in each row are connected in series to form a row branch, an input terminal of the row branch is connected to a corresponding light-emitting branch, and an output terminal of the row branch is connected to a feedback receiving terminal of the main control circuit.

In some embodiments, a number of columns of the matrix circuit corresponds to a logarithm of a number of at least two light-emitting branches with a base of 2, and control terminals of the first transistors in each column are connected to a corresponding feedback control terminal of the main control circuit.

In some embodiments, one of the at least two light-emitting branches includes a current regulator and a light-emitting device, and the main control circuit includes an electrical information comparator and a controller; the electrical information comparator is configured to compare the reference electrical parameter information and electrical information of the light-emitting device to obtain a comparison result; the controller is configured to control the current regulator according to the comparison result to adjust brightness of the light-emitting device.

In some embodiments, the light-emitting device includes one or more light-emitting diodes connected in series.

In some embodiments, the light-emitting device includes one or more cold cathode fluorescent tubes connected in series.

In some embodiments, the electrical information comparator includes a voltage comparator; the reference electrical information circuit includes a reference voltage circuit, and the reference electrical parameter information includes reference voltage information.

In some embodiments, the electrical information comparator includes a current comparator; the reference electrical information circuit includes a reference current circuit, and the reference electrical parameter information includes reference current information.

In some embodiments, the current regulator includes a second transistor connected to the one or more light-emitting diodes, and the second transistor is controlled by the controller.

In some embodiments, the second transistor includes a field effect transistor.

In some embodiments, the backlight adjustment circuit further includes a memory configured to store the reference voltage information provided to the reference voltage circuit.

In some embodiments, a voltage value provided by the reference voltage information is the same as a feedback voltage value when the at least two light-emitting branches work normally.

In some embodiments, the one or more light-emitting diodes are connected with a resistor in series and grounded.

In some embodiments, the feedback selection circuit is connected to a remote terminal of the resistor and is configured to collect voltage information on the resistor.

This application further provides a backlight module, including a backlight adjustment circuit and optical films, where the backlight adjustment circuit includes a reference electrical information circuit, a feedback selection circuit, a main control circuit and at least two parallel light-emitting branches; where the reference electrical information circuit is connected to the main control circuit and is configured to provide reference electrical parameter information to the main control circuit; the feedback selection circuit is respectively connected to the main control circuit and the at least two light-emitting branches and is configured to provide the main control circuit with electrical information of each of the at least two light-emitting branches; and the main control circuit is connected to the at least two light-emitting branches and is configured to adjust a current magnitude of the each of the at least two light-emitting branches according to the reference electrical parameter information and the electrical information of the each of the at least two light-emitting branches.

In some embodiments, the feedback selection circuit of the backlight adjustment circuit includes a matrix circuit configured to gate the at least two light-emitting branches, and the matrix circuit includes first transistors arranged in a matrix.

In some embodiments, the matrix circuit of the backlight adjustment circuit is provided with a number of rows corresponding to a number of the at least two light-emitting branches, the first transistors in each row are connected in series to form a row branch, an input terminal of the row branch is connected to a corresponding light-emitting branch, and an output terminal of the row branch is connected to a feedback receiving terminal of the main control circuit.

In some embodiments, a number of columns of the matrix circuit of the backlight adjustment circuit corresponds to a logarithm of a number of at least two light-emitting branches with a base of 2, and control terminals of the first transistors in each column are connected to a corresponding feedback control terminal of the main control circuit.

A display device, including a liquid crystal panel and the above-mentioned backlight module.

According to the backlight adjustment circuit provided by this application, a feedback selection circuit is provided, so that electrical information about the operation of each light-emitting branch may be fed back to a main control circuit. The main control circuit makes control judgment by comparing the feedback electrical information with reference electrical parameter information, so as to realize control of a current value of each light-emitting branch, and then realize control of brightness of each light-emitting branch, so as to obtain a uniform light-emitting backlight. On the other hand, compared with the traditional feedback circuit, because the feedback selection circuit is adopted, the number of interfaces connected to the main control circuit may be saved.

The details of one or more embodiments of this application are set forth in the following drawings and description. Other features and advantages of this application will become apparent from the description, drawings and claims.

BRIEF DESCRIPTION OF THE DRAWINGS

In order to more clearly describe the technical solutions in the embodiments of this application, the following will briefly introduce the drawings that need to be used in the description of the embodiments. Obviously, the drawings in the following description are only some embodiments of this application. For those of ordinary skill in the art, without creative work, other drawings can be obtained according to these drawings.

DETAILED DESCRIPTION OF THE EMBODIMENTS

In order to make the technical solutions and advantages of this application clearer, the following further describes this application in detail with reference to the accompanying drawings and embodiments. It should be understood that the specific embodiments described herein are only used to explain this application, and are not used to limit this application.

The backlight adjustment circuit provided in this application may be applied to the field of display technology. With the popularity of liquid crystal panels, the public has increasingly higher requirements for the image quality of liquid crystal displays. The liquid crystal panel itself does not emit light and requires backlight support for display. The quality of the backlight has an important influence on the display quality of the liquid crystal display, and the uniformity of the backlight is one of the important factors to measure the quality of the backlight. In some technologies, adjusting the uniformity of the backlight requires connecting each light-emitting branch of the backlight to the main control circuit to feed back relevant information, which will occupy a lot of feedback interfaces of the main control circuit.

Figure 1:
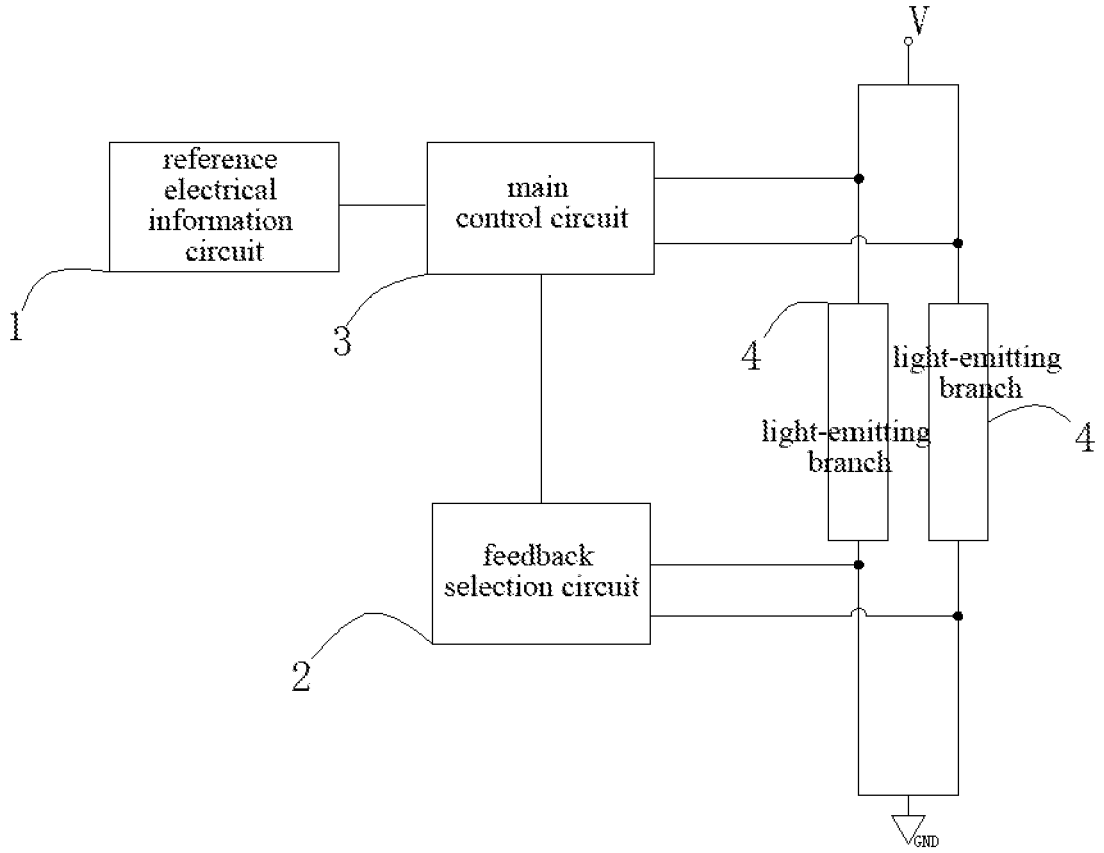
FIG. 1 is a structural block diagram of backlight adjustment according to one or more embodiments.

In one embodiment, as shown in FIG. 1, a backlight adjustment circuit is provided, which includes: a reference electrical information circuit 1, a feedback selection circuit 2, a main control circuit 3 and at least two parallel light-emitting branches 4. The reference electrical information circuit 1 is connected to the main control circuit 3 and is configured to provide reference electrical parameter information to the main control circuit 3. The feedback selection circuit 2 is respectively connected to the main control circuit 3 and the at least two light-emitting branches 4 and is configured to provide the main control circuit 3 with electrical information of each of the at least two light-emitting branches 4. The main control circuit 3 is connected to the at least two light-emitting branches 4 and is configured to adjust a current magnitude of the each of the at least two light-emitting branches 4 according to the reference electrical parameter information and the electrical information of the each of the at least two light-emitting branches 4.

Where, the light-emitting branch 4 emits light when it is working and provides a light source. The light-emitting branch 4 may include any light-emitting device, such as a light-emitting diode, an organic light-emitting diode, or a cold cathode fluorescent tube. The reference electrical information circuit 1 provides reference electrical parameter information for maintaining the operation of the light-emitting branch 4 to the main control circuit 3. The reference electrical parameter information may be voltage information, current information, or even power information. The feedback selection circuit 2 may gate one light-emitting branch 4 under the control of the main control circuit 3 to collect electrical information of the light-emitting branch 4 and feed the electrical information back to the main control circuit 3. The electrical information of the light-emitting branch 4 fed back by the feedback selection circuit 2 may be voltage information, current information, or even power information, as long as it corresponds to the reference electrical parameter information, so that the main control circuit 3 may compare the electrical information of the light-emitting branch 4 with the reference electrical parameter information. That is, if the reference electrical parameter information is voltage information, the feedback selection circuit 2 is also set to feed back voltage information of the light-emitting branch 4; similarly, if the reference electrical parameter information is current information, the electrical information of the light-emitting branch 4 fed back by the feedback selection circuit 2 is also current information. The main control circuit 3 compares the reference electrical parameter information with the electrical information of the light-emitting branch 4 to determine whether the light-emitting branch 4 needs to be adjusted, thereby controlling the light-emitting brightness of the light-emitting branch.

In this embodiment, the feedback selection circuit 2 is provided, so that the electrical information of each light-emitting branch 4 may be fed back to the main control circuit 3. The main control circuit 3 makes control judgment by comparing the feedback electrical information with the reference electrical parameter information, so as to realize control of a current value of each light-emitting branch 4, and then realize control of brightness of each light-emitting branch 4, so as to obtain a uniform light-emitting backlight. Due to the limited interfaces of the main control circuit 3, it is often necessary to reserve some interfaces for other circuits to connect. Therefore, compared with the traditional backlight adjustment circuit, this embodiment adopts the feedback selection circuit 2 and only needs to connect the main control circuit 3 with the feedback selection circuit 2, instead of connecting the main control circuit 3 to each light-emitting branch 4, which may save the number of interfaces connected to the main control circuit 3.

Figure 2:
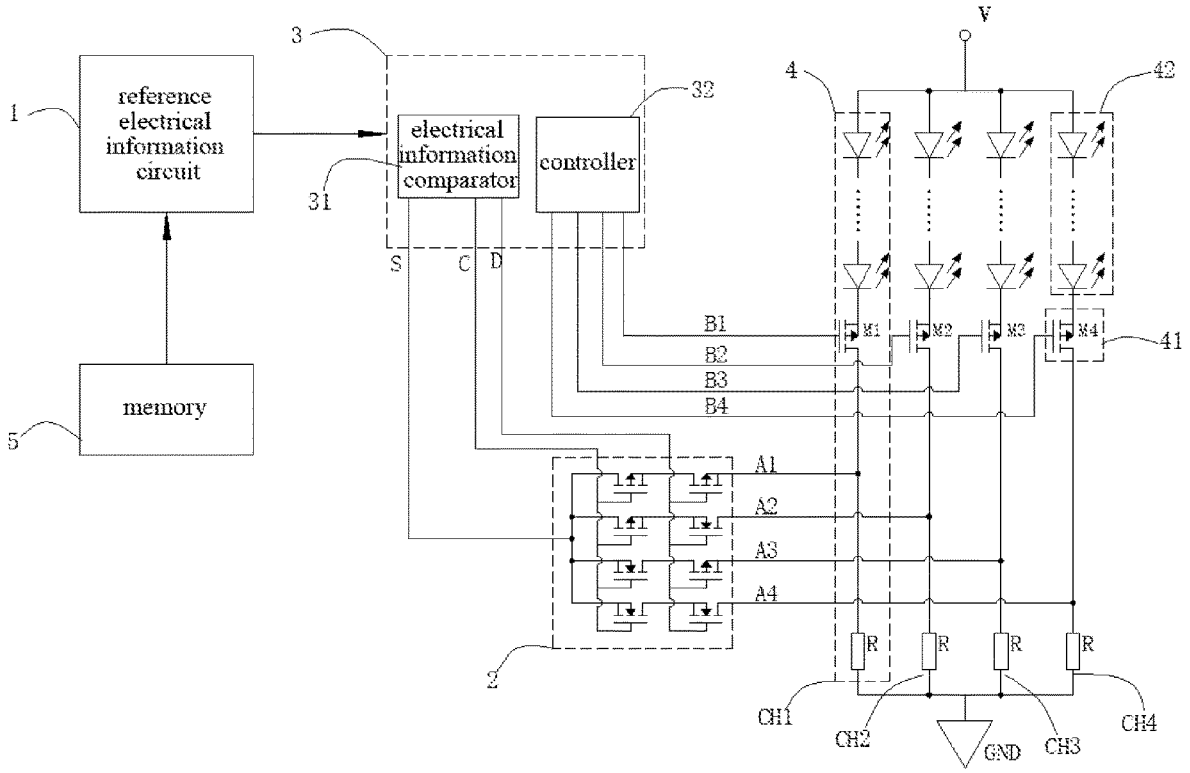
FIG. 2 is a circuit structural diagram of a backlight adjustment circuit according to one or more embodiments.

In some embodiments, as shown in FIG. 2, taking 4 light-emitting branches as an example, one light-emitting branch 4 is a light string on a light bar, including a number of light-emitting devices connected in series, the light-emitting branch 4 further includes a switch device and a resistor R connected in series, and the light-emitting device may be selected as a light-emitting diode. The light-emitting branches CH1 to CH4 are connected to the feedback selection circuit 2 through the feedback branches A1, A2, A3, and A4, respectively. In the traditional feedback circuit, if each branch needs to be fed back, each feedback branch needs to occupy an interface of the main control circuit 3. In this embodiment, through the conversion of the feedback selection circuit 2, only three interfaces of the main control circuit 3 are occupied, which may reduce the number of interfaces connected to the main control circuit 3.

The feedback selection circuit 2 feeds back the electrical information of each light-emitting branch 4 to the main control circuit 3 for electrical information comparison, if it is different from the reference electrical information, the main control circuit 3 will send a signal to control the switch devices M1 to M4, so as to control the current on each branch, so that the current of each light-emitting branch tends to be consistent, so that the brightness consistency of each light-emitting branch may be controlled in real time, and the backlight may be illuminated uniformly.

In one of the embodiments, the feedback selection circuit 2 includes a matrix circuit for gating the light-emitting branch, and the matrix circuit includes a plurality of first transistors. Where, the first transistors are arranged in an array to form a matrix circuit. A number of rows of the matrix circuit is a number of branches of the light-emitting branches 4. A number of columns of the matrix circuit is, taking the number of branches of the light-emitting branches 4 as the true number, and the logarithm with the base 2 as the rounded integer. Taking 4 light-emitting branches as an example, the number of rows of the matrix circuit is 4, and the number of columns is the logarithm of the number of branches based on 2, and the result is 2, so the matrix circuit has 2 columns. Similarly, with this calculation, if there are 8 light-emitting branches, the number of rows of the matrix circuit is 8 and the number of columns is 3. For another example, if there are 6 light-emitting branches, the number of rows of the matrix circuit is 6, and the number of columns is, the rounded integer of the logarithm of 6 based on 2, that is, since the logarithm is 2.6, then rounded up to 3, so the number of columns of the matrix circuit is 3.

A number of the first transistors in the matrix circuit is a product of the number of rows and the number of columns of the matrix circuit, and the first transistors are arranged according to the number of rows and columns mentioned above. The first transistors in each row are connected in series to form a row branch, an input terminal of the row branch is connected to the corresponding light-emitting branch 4, and an output terminal is connected to a common output terminal and then connected to the feedback receiving terminal of the main control circuit 3. Control terminals of the first transistors in each column are connected to a common control terminal and then connected to the corresponding feedback control terminal of the main control circuit 3. The first transistor may be a field effect transistor, and the field effect transistor may be a Metal-Oxide-Semiconductor Field-Effect Transistor (MOSFET). Because the source and drain of the MOSFET have symmetry, even if the two terminals are reversed, it will not affect the performance of the device. And, its on-resistance is also very small, if used in a voltage feedback circuit, the voltage drop caused by the on-resistance has little effect on the feedback signal, and it may accurately feed back voltage information to the main control circuit 3.

As shown in FIG. 2, taking four light-emitting branches as an example, the arrangement of the first transistors in the feedback selection circuit 2 is introduced as follows. To simplify the expression, the field effect transistors are arranged in this embodiment, where the N-type field effect transistor is represented by N, and the P-type field effect transistor is represented by P. The feedback selection circuit 2 is a matrix of 4 rows×2 columns, and the first row to the fourth row of the field effect transistors are arranged in the order of PP, PN, NP, and NN. If P corresponds to the binary number 0 and N corresponds to the binary number 1, then the arrangement of the field effect transistors corresponds to the order of the binary numbers 00, 01, 10, 11. Each row of the field effect transistors are connected in series to form a row branch, which is the first row branch to the fourth row branch. The input terminals of the first to fourth row branches are connected to the light-emitting branches CH1 to CH4 respectively, and the output terminals are commonly connected to a feedback receiving terminal S of the main control circuit 3. The control terminals of the first column of field effect transistors are connected to a first common control terminal and then connected to a corresponding feedback control terminal C of the main control circuit 3. The control terminals of the second column of field effect transistors are connected to a second common control terminal and then connected to a corresponding feedback control terminal D of the main control circuit 3. The feedback control terminal of the main control circuit 3 sends out the corresponding control signal, which may control the feedback selection circuit 2 to feedback the electrical information of the corresponding light-emitting branch 4, and then obtain the comparison result by comparing with the reference electrical parameter information, so as to adjust the brightness of each light-emitting branch 4.

In one of the embodiments, the light-emitting branch 4 includes a current regulator 41 and a light-emitting device 42, and the main control circuit 3 includes an electrical information comparator 31 and a controller 32. The electrical information comparator 31 is configured to compare the reference electrical parameter information with the electrical information of the light-emitting device 4, and the controller 32 is configured to control the current regulator 41 to adjust the current of the light-emitting branch 4. As shown in FIG. 2, each light-emitting branch 4 includes a current regulator 41. The current regulator 41 uses a second transistor as a regulator. The second transistor may be a field effect transistor, and the filed effect transistor may be a P-type MOSFET or an N-type MOSFET. In this embodiment, a field effect transistor is taken as an example. Each light-emitting branch adopts a P-type MOSFET as an adjustment device, and real-time adjustment of the current flowing through the light-emitting branch 4 may be realized by the current regulator 41 controlling the opening degree of the P-type MOSFET, so as to finally realize real-time control of the brightness of each light-emitting branch 4, so that each light-emitting branch maintains uniform brightness.

In one of the embodiments, the backlight adjustment circuit further includes a memory 5 to provide electrical parameter data for the reference electrical information circuit 1. The memory may be a non-volatile memory such as read-only memory, programmable read-only memory, electrically programmable read-only memory, and electrically erasable programmable read-only memory. The reference electrical information circuit 1 reads the electrical parameter data preset in the memory 5 to provide reference electrical parameter information to the main control circuit 3 so that the main control circuit 3 may compare the electrical information of the light-emitting branch.

In one of the embodiments, a voltage value provided by the reference voltage information is the same as a feedback voltage value when the at least two light-emitting branches work normally. In this embodiment, the electrical information comparator 31 includes a voltage comparator; the reference electrical information circuit includes a reference voltage circuit, and the reference electrical parameter information includes reference voltage information. The resistor R on each light-emitting branch is grounded, the feedback selection circuit 2 feeds back the voltage information of the remote terminal of the resistor to the main control circuit 3, and the voltage provided by the reference voltage circuit 1 is the same as the voltage across the resistor when the light-emitting branch works normally.

Certainly, in other embodiments, according to actual needs, the voltage feedback circuit may be designed to feed back the voltage value of other part of the light-emitting branch, as long as the reference voltage value provided by the reference electrical information circuit 1 is preset to be the same as the voltage value of this part when the light-emitting branch 4 is working normally.

Taking a backlight adjustment circuit with 4 light-emitting branches as an example, the backlight adjustment process is: the reference electrical information circuit 1 reads data from the memory 5, generates reference voltage information, and provides the reference voltage to the main control circuit 3. The main control circuit 3 sends a feedback control signal corresponding to each light-emitting branch 4 to the feedback selection circuit 2 to turn on the corresponding feedback branch and extract the electrical information of the corresponding light-emitting branch 4. Optionally, since the feedback selection circuit 2 is provided, each feedback branch corresponds to a row branch in the feedback selection circuit 2, that is, the feedback branches A1 to A4 respectively correspond to the first to fourth row branches, and the arrangement of the transistors of each row branch corresponds to a binary number, and the 0 and 1 of the binary number may be expressed in low and high levels. Therefore, only the control terminals of each column of transistors are commonly connected to a corresponding feedback control terminal of the main control circuit 3, the main control circuit 3 outputs the high and low level combined signal of the binary number corresponding to the feedback branch, so that the corresponding feedback branch may be turned on. That is, as shown in FIG. 2, the main control circuit 3 outputs a feedback control signal of "00", that is, the feedback control terminal C and the feedback control terminal D both output low level, then the feedback branch A1 is turned on, and the operation electrical information of the light-emitting branch is provided to the feedback receiving terminal S of the main control circuit 3. The main control circuit 3 extracts the operation electrical information of the light-emitting branch CH1 and compares it with the reference electrical information, and adjusts the brightness of the light-emitting branch according to the comparison result. Taking the reference electrical information circuit 1 to provide a reference voltage and the feedback selection circuit 2 to feed back the operation voltage of the light-emitting branch 4 as an example, the first light-emitting branch CH1 corresponds to the feedback branch A1, and the corresponding current regulator 41 is a MOSFET M1. If the voltage value fed back by the feedback branch A1 is higher than the reference voltage value, the voltage applied to the control terminal of the MOSFET M1 is reduced to reduce the current passing through the MOSFET M1, thereby reducing the light-emitting brightness of the corresponding light-emitting branch CH1. If the feedback voltage value is lower than the reference voltage value, the voltage applied to the control terminal of the MOSFET M1 is increased to increase the current passing through the MOSFET M1, thereby improving the light-emitting brightness of the corresponding light-emitting branch CH1. If the feedback voltage value is equal to the reference voltage, there is no need to adjust the branch. The main control circuit 3 outputs a feedback control signal of "01", that is, the feedback control terminal C outputs a low level, and the feedback control terminal D outputs a high level, then the feedback branch A2 is turned on. The main control circuit 3 extracts the feedback voltage value of the light-emitting branch CH2 and compare it with the reference voltage, and adjust the light-emitting branch CH2 in the same manner as the aforementioned adjustment method for the light-emitting branch CH1 according to the comparison result. By analogy, the main control circuit 3 outputs a feedback control signal of "10", that is, the feedback control terminal C outputs a high level, and the feedback control terminal D outputs a low level, then the feedback branch A3 is turned on, and the main control circuit 3 extracts the feedback voltage value of the light-emitting branch CH3. The main control circuit 3 outputs the feedback control signal of "11", that is, both the feedback control terminal C and the feedback control terminal D output high level, then the feedback branch A4 is turned on, and the main control circuit 3 extracts the feedback voltage value of the light-emitting branch CH4. In this way, the feedback voltage value of each light-emitting branch is extracted cyclically to adjust the current of each feedback branch. The adjustment process introduced in this embodiment may realize real-time adjustment of the current of each light-emitting branch, and because the light-emitting diode is a current device, its light-emitting brightness is positively correlated with the current flowing through it, so it may realize the real-time adjustment of the light-emitting brightness of each light-emitting branch, so that the brightness of each light-emitting branch is consistent, and the light-emitting of the backlight is kept uniform. In other backlight adjustment circuits with different numbers of light-emitting branches, the backlight adjustment method may be deduced by analogy, and will not be repeated.

It should be noted that the feedback control signal of the main control circuit 3 in this embodiment expresses the "0" in the binary number with a low level and expresses the "1" in the binary number with a high level. Actually, it is not limited to this. The "0" in the binary number may be expressed with a high level and the "1" in the binary number may be expressed with a low level, or any two other signals that may be distinguished from each other may be used, as long as the corresponding feedback branch may be turned on under the corresponding feedback control signal by adjusting the arrangement of the N MOSFET and P MOSFET in the feedback selection circuit 2 accordingly.

Figure 3:
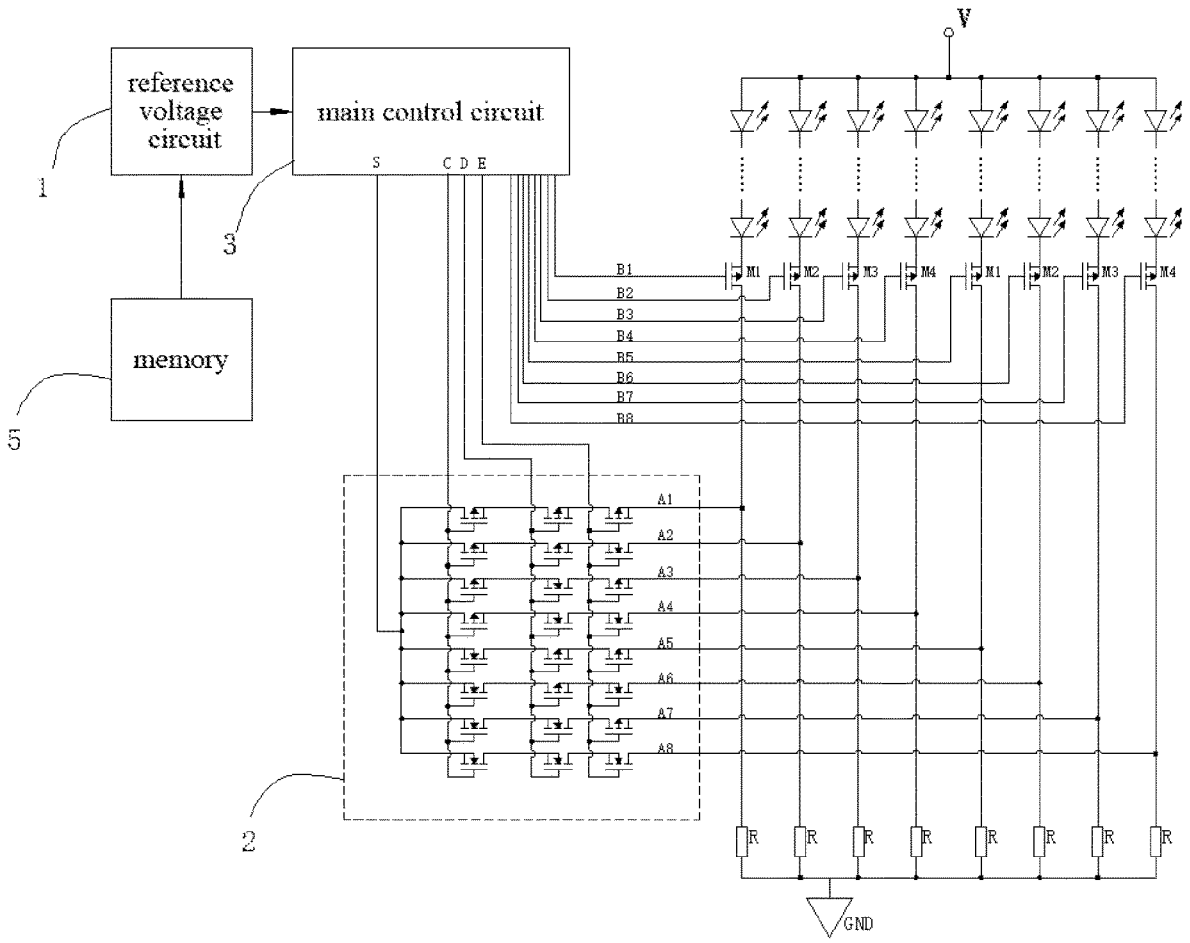
FIG. 3 is a circuit structural diagram of a backlight adjustment circuit according to one or more embodiments.

In one of the embodiments, as shown in FIG. 3, the light-emitting branch of the backlight adjustment circuit provided by this application may expand a larger number of light-emitting branches. Taking 8 light-emitting branches as an example, the light-emitting device adopts light-emitting diodes, the adjustment device on the light-emitting branch adopts MOSFET, and the feedback selection circuit 2 adopts an N-P type MOSFET matrix composed of N-type MOSFETs and P-type MOSFETs. To simplify the description, the N-type MOSFET in this embodiment is represented by N, and the P-type MOSFET is represented by P. The feedback selection circuit 2 is a matrix of 8 rows×3 columns, and the transistors in the first row to the eighth row are arranged in the order of PPP, PPN, PNP, PNN, NPP, NPN, NNP, NNN, which corresponds to the order of binary numbers 000, 001, 010, 011, 100, 101, 110, 111. The MOSFETs in each row are connected in series to form a row branch, which are the first row branch to the eighth row branch, that is, the branches A1 to A7 in the FIG. 3. The input terminals of the first row branch to the eighth row branch are respectively connected to the corresponding light-emitting branches in turn, and the output terminals are commonly connected to the common output terminal and then connected to the feedback receiving terminal S of the main control circuit 3. The control terminals of each column of MOSFETs in each column are connected to the common control terminal and then connected to a corresponding feedback control terminal of the main control circuit 3, which is a feedback control terminal C, a feedback control terminal D, and a feedback control terminal E, respectively. The feedback control terminal of the main control circuit 3 sends out the corresponding control signal, which may control the voltage feedback circuit to feedback the voltage of the corresponding light-emitting branch 4, and then obtain the comparison result by comparing with the reference voltage information, so as to adjust the brightness of each light-emitting branch 4 to maintain the uniformity of the backlight. Through the conversion of the feedback selection circuit 2, only four feedback interfaces of the main control circuit 3 are occupied, while the traditional feedback circuit requires eight feedback interfaces if each branch needs to be fed back. It can be seen that with the feedback selection circuit 2, the number of interfaces connected to the main control circuit 3 by the voltage feedback circuit are reduced.

Figure 4:
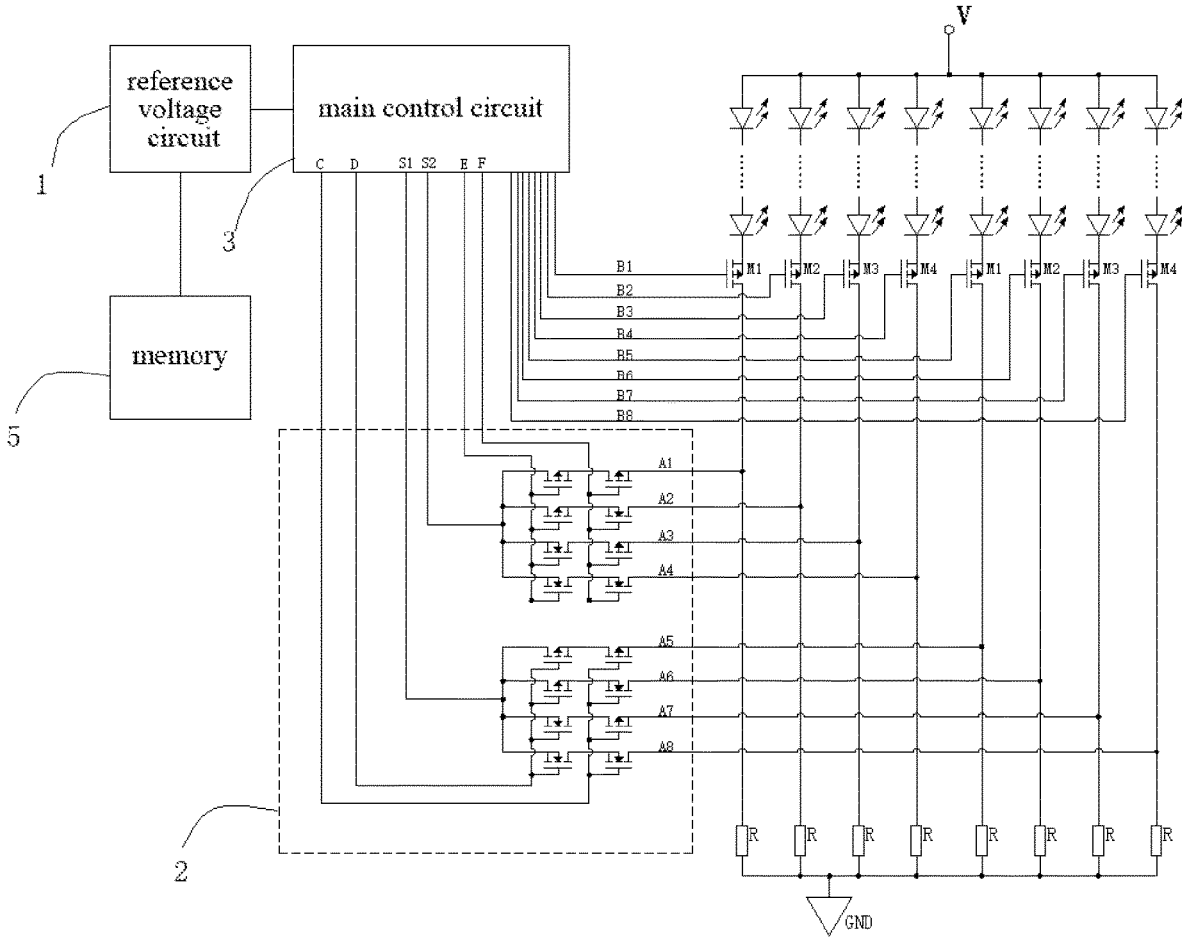
FIG. 4 is a circuit structure diagram of a backlight adjustment circuit according to another embodiment.

In another embodiment, as shown in FIG. 4, taking 8 light-emitting branches as an example, this embodiment provides another implementation manner for expanding the number of light-emitting branches. Take each 4 light-emitting branches as a group, and each group is indepterminalently connected to the main control circuit 3 according to the connection manner of the four light-emitting branches, that is: the feedback selection circuit 2 of each group of voltage feedback circuits are arranged in a matrix of 4 rows×2 columns, and each row is arranged in the way of PP, PN, NP, NN, which corresponds to the order of binary numbers 00, 01, 10, 11. The MOSFETs in each row are connected in series to form a row branch, which are the first row branch to the fourth row branch. The input terminals of the first row branch to the fourth row branch are respectively connected to the corresponding light-emitting branches, and the output terminals are connected to the common output terminal and then connected to the feedback receiving terminal 51 of the main control circuit 3. The control terminals of each column of transistors are connected to the common control terminal and then connected to a corresponding feedback control terminal of the main control circuit 3, which is a feedback control terminal C and a feedback control terminal D. The other group also arranges the field effect transistors in the same way to connect the feedback selection circuit 2 to the feedback receiving terminal S2, the feedback control terminal E, and the feedback control terminal F of the main control circuit. In this way, the main control circuit 3 may also adjust the brightness of each light-emitting branch in real time, so as to keep the backlight uniform. Compared with the traditional connection method of the voltage feedback circuit, the number of interfaces may also be saved.

A backlight module including the backlight adjustment circuit provided by any one of the above embodiments and optical films, where the backlight adjustment circuit includes a reference electrical information circuit, a feedback selection circuit, a main control circuit and at least two parallel light-emitting branches.

This application further provides a display device, including the backlight adjustment circuit provided by any one of the above embodiments or the above backlight module. The display device provided in this embodiment may be any display device including a backlight, such as a liquid crystal display television or a liquid crystal display.

The technical features of the above embodiments can be combined arbitrarily. In order to make the description concise, all possible combinations of the technical features in the above embodiments are not described. However, as long as there is no contradiction between the combinations of these technical features, they should be considered as the range described in this specification.

The above-mentioned embodiments only express several implementation manners of this application, and the description is relatively specific and detailed, but it should not be understood as a limitation on the scope of the patent. It should be pointed out that for those of ordinary skill in the art, without departing from the concept of this application, several modifications and improvements can be made, and these all fall within the protection scope of this application. Therefore, the scope of protection of the patent of this application shall be subject to the appterminaled claims.

What is claimed is:

1. A backlight adjustment circuit, comprising:

a reference electrical information circuit, a feedback selection circuit, a main control circuit and at least two parallel light-emitting branches;

wherein the reference electrical information circuit is connected to the main control circuit and is configured to provide reference electrical parameter information to the main control circuit; the feedback selection circuit is respectively connected to the main control circuit and the at least two light-emitting branches and is configured to provide the main control circuit with electrical information of each of the at least two light-emitting branches; and the main control circuit is connected to the at least two light-emitting branches and is configured to adjust a current magnitude of the each of the at least two light-emitting branches according to the reference electrical parameter information and the electrical information of the each of the at least two light-emitting branches;

the feedback selection circuit comprises a matrix circuit configured to gate the at least two light-emitting branches, the matrix circuit comprises first transistors arranged in a matrix, the first transistors are arranged in several rows corresponding to a number of the light-emitting branches, the first transistors in each row are connected in series to form a row branch, an input terminal of the row branch is connected to a corresponding light-emitting branch, and an output terminal of the row branch is connected to a feedback receiving terminal of the main control circuit, a number of columns of the matrix circuit corresponds to a logarithm of a number of the light-emitting branches with a base of 2, and control terminals of the first transistors in each column are connected to a corresponding feedback control terminal of the main control circuit.

2. The backlight adjustment circuit of claim 1, wherein one of the at least two light-emitting branches comprises a current regulator and a light-emitting device, and the main control circuit comprises an electrical information comparator and a controller; the electrical information comparator is configured to compare the reference electrical parameter information and electrical information of the light-emitting device to obtain a comparison result; and the controller is configured to control the current regulator according to the comparison result to adjust brightness of the light-emitting device.

3. The backlight adjustment circuit of claim 2, wherein the light-emitting device comprises one or more light-emitting diodes connected in series.

4. The backlight adjustment circuit of claim 2, wherein the light-emitting device comprises one or more cold cathode fluorescent tubes connected in series.

5. The backlight adjustment circuit of claim 3, wherein the electrical information comparator comprises a voltage comparator; the reference electrical information circuit comprises a reference voltage circuit, and the reference electrical parameter information comprises reference voltage information.

6. The backlight adjustment circuit of claim 3, wherein the electrical information comparator comprises a current comparator; the reference electrical information circuit comprises a reference current circuit, and the reference electrical parameter information comprises reference current information.

7. The backlight adjustment circuit of claim 5, wherein the current regulator comprises a second transistor connected to the one or more light-emitting diodes, and the second transistor is controlled by the controller.

8. The backlight adjustment circuit of claim 7, wherein the second transistor comprises a field effect transistor.

9. The backlight adjustment circuit of claim 8, further comprising a memory configured to store the reference voltage information provided to the reference voltage circuit.

10. The backlight adjustment circuit of claim 9, wherein a voltage value provided by the reference voltage information is the same as a feedback voltage value when the at least two light-emitting branches work normally.

11. The backlight adjustment circuit of claim 10, wherein the one or more light-emitting diodes are connected with a resistor in series and grounded.

12. The backlight adjustment circuit of claim 11, wherein the feedback selection circuit is connected to a remote terminal of the resistor and is configured to collect voltage information on the resistor.

13. A backlight module, comprising a backlight adjustment circuit and optical films, wherein the backlight adjustment circuit comprises a reference electrical information circuit, a feedback selection circuit, a main control circuit and at least two parallel light-emitting branches; wherein the reference electrical information circuit is connected to the main control circuit and is configured to provide reference electrical parameter information to the main control circuit; the feedback selection circuit is respectively connected to the main control circuit and the at least two light-emitting branches and is configured to provide the main control circuit with electrical information of each of the at least two light-emitting branches; and the main control circuit is connected to the at least two light-emitting branches and is configured to adjust a current magnitude of the each of the at least two light-emitting branches according to the reference electrical parameter information and the electrical information of the each of the at least two light-emitting branches;

the feedback selection circuit comprises a matrix circuit configured to gate the at least two light-emitting branches, the matrix circuit comprises first transistors arranged in a matrix, the first transistors are arranged in several rows corresponding to a number of the light-emitting branches, the first transistors in each row are connected in series to form a row branch, an input terminal of the row branch is connected to a corresponding light-emitting branch, and an output terminal of the row branch is connected to a feedback receiving terminal of the main control circuit, a number of columns of the matrix circuit corresponds to a logarithm of a number of the light-emitting branches with a base of 2, and control terminals of the first transistors in each column are connected to a corresponding feedback control terminal of the main control circuit.

14. A display device, comprising a liquid crystal panel and the backlight module as recited in claim 13.

* * * * *